US006487795B1

(12) United States Patent
Ellis, III

(10) Patent No.: US 6,487,795 B1
(45) Date of Patent: Dec. 3, 2002

(54) SHOE SOLE STRUCTURES

(75) Inventor: Frampton E. Ellis, III, Arlington, VA (US)

(73) Assignee: Anatomic Research, Inc., Arlington, VA (US)

( * ) Notice: Subject to any disclaimer, the term of this patent is extended or adjusted under 35 U.S.C. 154(b) by 0 days.

(21) Appl. No.: 08/479,776

(22) Filed: Jun. 7, 1995

Related U.S. Application Data

(63) Continuation of application No. 07/926,523, filed on Aug. 10, 1992, now abandoned, which is a continuation of application No. 07/463,302, filed on Jan. 10, 1990, now abandoned.

(51) Int. Cl.[7] ..... A43B 13/18; A43B 13/20

(52) U.S. Cl. ..... 36/28; 36/103; 36/29; 36/30 R

(58) Field of Search ..... 36/25 R, 28, 29, 36/30 R, 31, 45, 102, 103

(56) References Cited

U.S. PATENT DOCUMENTS

| | | | |
|---|---|---|---|
| 288,127 | A | 11/1883 | Shepard |
| 532,429 | A | 1/1895 | Rogers |
| 1,283,335 | A | 10/1918 | Shillcock |

(List continued on next page.)

FOREIGN PATENT DOCUMENTS

| | | |
|---|---|---|
| AT | 200963 | 5/1958 |
| CA | 1 138 194 | 12/1982 |
| CA | 1 176 458 | 10/1984 |

(List continued on next page.)

OTHER PUBLICATIONS

Williams, Walking on Air, *Case Alumnus*, vol. LXVII, No. 6, Fall 1989, pp. 4–8.
Brooks advertisement in *Runner's World* etc., Jun. 1989, pp. 56+.
Nigg et al., Influence of Heel Flare and Midsole Construction on Pronation, Supination, and Impact Forces for Heel-Toe Running, *International Journal of Sports Biomechanics*, 1988, 4, pp. 205–219.
Nigg et al., The influence of lateral heel flare of running shoes on pronation and impact forces, *Medicine and Science in Sports and Exercise*, vol. 19, No. 3, 1987, pp. 294–302.
Cavanagh et al., Biological Aspects of Modeling Shoe/Foot Interaction During Running, *Sport Shoes and Playing Surfaces*, 1984, pp. 24–25, 32–35, 46.
Blechschmidt, The Structure of the Calcaneal Padding, *Foot & Ankle*, vol. 2, No. 5, Mar. 1982, pp. 260–283.
Cavanagh, *The Running Shoe Book*, © 1980, pp. 176–180, Anderson World, Inc., Mountain View, CA.
Executive Summary with seven figures.
German description of adidas badminton shoe, pre–1989(?), 1 page.
The Reebok Lineup, Fall 1987, 2 pages.

*Primary Examiner*—Ted Kavanaugh
(74) *Attorney, Agent, or Firm*—Finnegan, Henderson, Farabow, Garrett & Dunner, LLP

(57) ABSTRACT

A shoe having improved stability and cushioning by incorporating aspects similar to certain structures of the human foot. The shoe includes a shoe sole having a contour similar to that of the human foot, including a sole inner surface and a sole outer surface each having concavely rounded portions. The shoe sole further includes a compartment or compartments to provide cushioning similar to the fat pads of the human foot. The compartment or compartments include a pressure transmitting medium, such as a gas, gel or liquid. The shoe may also include a shoe upper enveloping at least a part of the shoe sole to provide stability similar to that provided by the outer surface of the human foot.

77 Claims, 6 Drawing Sheets

U.S. PATENT DOCUMENTS

| | | | | |
|---|---|---|---|---|
| 1,289,106 | A | | 12/1918 | Bullock |
| 1,458,446 | A | | 6/1923 | Shaeffer |
| 1,622,860 | A | | 3/1927 | Cutler |
| 1,639,381 | A | | 8/1927 | Manelas |
| 1,701,260 | A | * | 2/1929 | Fischer |
| 1,735,986 | A | | 11/1929 | Wray |
| 1,853,034 | A | | 4/1932 | Bradley |
| 2,120,987 | A | | 7/1938 | Murray |
| 2,147,197 | A | | 2/1939 | Glidden |
| 2,155,166 | A | * | 4/1939 | Kraft |
| 2,170,652 | A | | 8/1939 | Brennan |
| 2,179,942 | A | | 11/1939 | Lyne |
| 2,328,242 | A | | 8/1943 | Witherill |
| 2,433,329 | A | | 12/1947 | Adler et al. |
| 2,434,770 | A | | 1/1948 | Lutey |
| 2,627,676 | A | | 2/1953 | Hack |
| 2,718,715 | A | | 9/1955 | Spilman |
| 2,814,133 | A | | 11/1957 | Herbst |
| 3,005,272 | A | | 10/1961 | Shelare et al. |
| 3,100,354 | A | | 8/1963 | Lombard et al. |
| 3,110,971 | A | | 11/1963 | Chang |
| 3,305,947 | A | | 2/1967 | Kalsoy |
| 3,308,560 | A | | 3/1967 | Jones |
| 3,416,174 | A | | 12/1968 | Novitske |
| 3,512,274 | A | | 5/1970 | McGrath |
| 3,535,799 | A | | 10/1970 | Onitsuka |
| 3,806,974 | A | | 4/1974 | Di Paolo |
| 3,824,716 | A | | 7/1974 | Di Paolo |
| 3,863,366 | A | | 2/1975 | Auberry et al. |
| 3,958,291 | A | | 5/1976 | Spier |
| 3,964,181 | A | | 6/1976 | Holcombe, Jr. |
| 3,997,984 | A | | 12/1976 | Hayward |
| 4,003,145 | A | | 1/1977 | Liebscher et al. |
| 4,030,213 | A | | 6/1977 | Daswick |
| 4,068,395 | A | | 1/1978 | Senter |
| 4,083,125 | A | | 4/1978 | Benseler et al. |
| 4,096,649 | A | | 6/1978 | Saurwein |
| 4,098,011 | A | | 7/1978 | Bowerman et al. |
| 4,128,951 | A | | 12/1978 | Tansill |
| 4,141,158 | A | | 2/1979 | Benseler et al. |
| 4,145,785 | A | | 3/1979 | Lacey |
| 4,149,324 | A | | 4/1979 | Lesser et al. |
| 4,161,828 | A | | 7/1979 | Benseler et al. |
| 4,161,829 | A | | 7/1979 | Wayser |
| 4,170,078 | A | | 10/1979 | Moss |
| 4,183,156 | A | | 1/1980 | Rudy |
| 4,194,310 | A | | 3/1980 | Bowerman |
| 4,217,705 | A | | 8/1980 | Donzis |
| 4,219,945 | A | | 9/1980 | Rudy |
| 4,223,457 | A | | 9/1980 | Borgeas |
| 4,227,320 | A | | 10/1980 | Borgeas |
| 4,235,026 | A | | 11/1980 | Plagenhoef |
| 4,240,214 | A | | 12/1980 | Sigle et al. |
| 4,241,523 | A | | 12/1980 | Daswick |
| 4,245,406 | A | | 1/1981 | Landay et al. |
| 4,250,638 | A | | 2/1981 | Linnemann |
| 4,258,480 | A | | 3/1981 | Famolare, Jr. |
| 4,259,792 | A | | 4/1981 | Halberstadt |
| 4,262,433 | A | | 4/1981 | Hagg et al. |
| 4,263,728 | A | | 4/1981 | Frecentese |
| 4,266,349 | A | | 5/1981 | Schmohl |
| 4,268,980 | A | | 5/1981 | Gudas |
| 4,271,606 | A | | 6/1981 | Rudy |
| 4,272,858 | A | | 6/1981 | Hlustik |
| 4,274,211 | A | | 6/1981 | Funck |
| 4,297,797 | A | | 11/1981 | Meyers |
| 4,302,892 | A | | 12/1981 | Adamik |
| 4,305,212 | A | | 12/1981 | Coomer |
| 4,308,671 | A | | 1/1982 | Bretschneider |
| 4,309,832 | A | | 1/1982 | Hunt |
| 4,316,332 | A | | 2/1982 | Giese et al. |
| 4,316,335 | A | | 2/1982 | Giese et al. |
| 4,319,412 | A | | 3/1982 | Muller et al. |
| 4,322,895 | A | | 4/1982 | Hockerson |
| 4,335,529 | A | | 6/1982 | Badalamenti |
| 4,340,626 | A | | 7/1982 | Rudy |
| 4,342,161 | A | | 8/1982 | Schmohl |
| 4,348,821 | A | | 9/1982 | Daswick |
| 4,354,319 | A | | 10/1982 | Block et al. |
| 4,361,971 | A | | 12/1982 | Bowerman |
| 4,366,634 | A | | 1/1983 | Giese et al. |
| 4,370,817 | A | | 2/1983 | Ratanangsu |
| 4,372,059 | A | | 2/1983 | Ambrose |
| 4,398,357 | A | | 8/1983 | Batra |
| 4,399,620 | A | | 8/1983 | Funck |
| 4,449,306 | A | | 5/1984 | Cavanagh |
| 4,451,994 | A | | 6/1984 | Fowler |
| 4,454,662 | A | | 6/1984 | Stubblefield |
| 4,455,765 | A | | 6/1984 | Sjöswärd |
| 4,455,767 | A | | 6/1984 | Bergmans |
| 4,468,870 | A | | 9/1984 | Sternberg |
| 4,484,397 | A | | 11/1984 | Curley, Jr. |
| 4,494,321 | A | | 1/1985 | Lawlor |
| 4,505,055 | A | * | 3/1985 | Bergmans |
| 4,506,462 | A | | 3/1985 | Cavanagh |
| 4,521,979 | A | | 6/1985 | Blaser |
| 4,527,345 | A | | 7/1985 | Lopez Lopez |
| 4,542,598 | A | | 9/1985 | Misevich et al. |
| 4,546,559 | A | | 10/1985 | Dassler |
| 4,557,059 | A | | 12/1985 | Misevich et al. |
| 4,559,723 | A | * | 12/1985 | Hamy et al. |
| 4,559,724 | A | | 12/1985 | Norton |
| 4,561,195 | A | | 12/1985 | Onoda et al. |
| 4,577,417 | A | | 3/1986 | Cole |
| 4,578,882 | A | | 4/1986 | Talarico, II |
| 4,580,359 | A | | 4/1986 | Kurrash et al. |
| 4,624,061 | A | | 11/1986 | Wezel et al. |
| 4,624,062 | A | | 11/1986 | Autry |
| 4,641,438 | A | | 2/1987 | Laird et al. |
| 4,642,917 | A | | 2/1987 | Ungar |
| 4,651,445 | A | | 3/1987 | Hannibal |
| 4,670,995 | A | | 6/1987 | Huang |
| 4,676,010 | A | | 6/1987 | Cheskin |
| 4,694,591 | A | | 9/1987 | Banich et al. |
| 4,697,361 | A | | 10/1987 | Ganter et al. |
| D293,275 | S | | 12/1987 | Bua |
| 4,715,133 | A | | 12/1987 | Hartjes et al. |
| 4,724,622 | A | | 2/1988 | Mills |
| D294,425 | S | | 3/1988 | Le |
| 4,727,660 | A | | 3/1988 | Bernhard |
| 4,730,402 | A | | 3/1988 | Norton et al. |
| 4,731,939 | A | | 3/1988 | Parracho et al. |
| 4,747,220 | A | | 5/1988 | Autry et al. |
| D296,149 | S | | 6/1988 | Diaz |
| D296,152 | S | | 6/1988 | Selbiger |
| 4,748,753 | A | | 6/1988 | Ju |
| 4,754,561 | A | | 7/1988 | Dufour |
| 4,756,098 | A | | 7/1988 | Boggia |
| 4,757,620 | A | | 7/1988 | Tiitola |
| 4,759,136 | A | | 7/1988 | Stewart et al. |
| 4,768,295 | A | | 9/1988 | Ito |
| 4,785,557 | A | | 11/1988 | Kelley et al. |
| 4,817,304 | A | | 4/1989 | Parker et al. |
| 4,827,631 | A | | 5/1989 | Thornton |
| 4,833,795 | A | | 5/1989 | Diaz |
| 4,837,949 | A | | 6/1989 | Dufour |
| 4,854,057 | A | | 8/1989 | Misevich et al. |
| 4,858,340 | A | | 8/1989 | Pasternak |
| 4,866,861 | A | | 9/1989 | Noone |
| 4,876,807 | A | | 10/1989 | Tiitola et al. |
| 4,890,398 | A | * | 1/1990 | Thomasson |

| | | | | |
|---|---|---|---|---|
| 4,906,502 | A | | 3/1990 | Rudy |
| 4,922,631 | A | | 5/1990 | Anderie |
| 4,934,070 | A | | 6/1990 | Mauger |
| 4,934,073 | A | | 6/1990 | Robinson |
| 4,947,560 | A | | 8/1990 | Fuerst et al. |
| 4,949,476 | A | | 8/1990 | Anderie |
| 4,982,737 | A | | 1/1991 | Guttmann |
| 4,989,349 | A | | 2/1991 | Ellis, III |
| D315,634 | S | | 3/1991 | Yung-Mao |
| 5,010,662 | A | | 4/1991 | Dabuzhsky et al. |
| 5,014,449 | A | | 5/1991 | Richard et al. |
| 5,024,007 | A | | 6/1991 | DuFour |
| 5,025,573 | A | | 6/1991 | Giese et al. |
| 5,052,130 | A | | 10/1991 | Barry et al. |
| 5,077,916 | A | | 1/1992 | Beneteau |
| 5,079,856 | A | | 1/1992 | Truelsen |
| 5,092,060 | A | | 3/1992 | Frachey et al. |
| 5,131,173 | A | | 7/1992 | Anderie |
| 5,224,280 | A | | 7/1993 | Preman et al. |
| 5,224,810 | A | | 7/1993 | Pitkin |
| 5,237,758 | A | | 8/1993 | Zachman |
| 5,317,819 | A | * | 6/1994 | Ellis, III |
| 5,543,194 | A | | 8/1996 | Rudy |
| 5,544,429 | A | | 8/1996 | Ellis, III |
| 5,909,948 | A | * | 6/1999 | Ellis, III |
| 6,115,941 | A | * | 9/2000 | Ellis, III |
| 6,115,945 | A | | 9/2000 | Ellis, III |
| 6,163,982 | A | | 12/2000 | Ellis, III |

FOREIGN PATENT DOCUMENTS

| | | | | |
|---|---|---|---|---|
| DE | B 23257 VII/71a | | | 5/1956 |
| DE | 1 888 119 | | | 12/1963 |
| DE | 1 287 477 | | | 1/1969 |
| DE | 1 290 844 | | | 3/1969 |
| DE | 1 685 260 | | | 10/1971 |
| DE | 27 06 645 | | | 8/1978 |
| DE | 27 37 765 | | | 3/1979 |
| DE | 28 05 426 | | | 8/1979 |
| DE | 30 24 587 | A1 | | 1/1982 |
| DE | 32 45 182 | | | 5/1983 |
| DE | 33 17 462 | | | 10/1983 |
| DE | 36 29 245 | | | 3/1988 |
| EP | 0 048 965 | | | 4/1982 |
| EP | 0 083 449 | A1 | | 12/1982 |
| EP | 0 130 816 | | | 1/1985 |
| EP | 0 185 781 | | | 7/1986 |
| EP | 0 206 511 | | | 12/1986 |
| EP | 0 213 257 | | | 3/1987 |
| EP | 0 215 974 | | | 4/1987 |
| EP | 0 238 995 | | | 9/1987 |
| EP | 0 260 777 | | | 3/1988 |
| EP | 0 301 331 | | | 2/1989 |
| EP | 0 329 391 | | | 8/1989 |
| EP | 0 410 087 | | | 1/1991 |
| FR | 602.501 | | | 3/1926 |
| FR | 925.961 | | | 9/1947 |
| FR | 1.004.472 | | | 3/1952 |
| FR | 1.323.455 | | | 2/1963 |
| FR | 2.006.270 | | | 11/1972 |
| FR | 2 261 721 | | | 9/1975 |
| FR | 2 511 850 | | | 3/1983 |
| FR | 2 622 411 | | | 5/1989 |
| GB | 16143 | | | of 1892 |
| GB | 9591 | | | of 1913 |
| GB | 764956 | | | 1/1957 |
| GB | 807305 | | | 1/1959 |
| GB | 2 023 405 | | | 1/1980 |
| GB | 2 039 717 | | | 8/1980 |
| GB | 2 136 670 | | | 9/1984 |
| JP | 39-15597 | | | 8/1964 |
| JP | 45-5154 | | | 3/1970 |
| JP | 50-71132 | | | 11/1975 |
| JP | 57-139333 | | | 8/1982 |
| JP | 59-23525 | | | 7/1984 |
| JP | 61-55810 | | | 4/1986 |
| JP | 61-167810 | | | 10/1986 |
| JP | 1-195803 | | | 8/1989 |
| JP | 3-85102 | | | 4/1991 |
| JP | 4-279102 | | | 10/1992 |
| JP | 5-123204 | | | 5/1993 |
| NZ | 189890 | | | 9/1981 |
| WO | WO 87/07480 | | | 12/1987 |
| WO | WO 88/08263 | | | 11/1988 |
| WO | WO 89/06500 | | | 7/1989 |
| WO | 90/00358 | | * | 1/1990 |
| WO | WO 91/00698 | | | 1/1991 |
| WO | WO 91/03180 | | | 3/1991 |
| WO | WO 91/04683 | | | 4/1991 |
| WO | WO 91/05491 | | | 5/1991 |
| WO | 9110377 | | * | 7/1991 |
| WO | WO 91/11124 | | | 8/1991 |
| WO | WO 91/11924 | | | 8/1991 |
| WO | WO 91/19429 | | | 12/1991 |
| WO | WO 92/07483 | | | 5/1992 |
| WO | WO 92/18024 | | | 10/1992 |
| WO | WO 93/13928 | | | 7/1993 |
| WO | WO 94/03080 | | | 2/1994 |
| WO | WO 97/00029 | | | 1/1997 |
| WO | WO 00/54616 | | | 9/2000 |
| WO | WO 00/64293 | A1 | | 11/2000 |
| WO | WO 01/80678 | A2 | | 11/2001 |

* cited by examiner

UNLOADED, UPRIGHT

LOADED MODERATELY, UPRIGHT

LOADED HEAVILY, UPRIGHT

LOADED HEAVILY, 20° LATERAL TILT

SHOE SOLE STRUCTURES

This application is a continuation of U.S. patent application Ser. No. 07/926,523, filed Aug. 10, 1992, now abandoned, which is a continuation of U.S. patent application Ser. No. 07/463,302, filed Jan. 10, 1990, now abandoned.

BACKGROUND OF THE INVENTION

This invention relates generally to the structure of footwear. More specifically, this invention relates to the structure of athletic shoe soles that copy features of the underlying support, stability and cushioning structures of the human foot. For example, this invention relates to support and cushioning which is provided by shoe sole compartments filled with a pressure-transmitting medium like liquid, gas, or gel. The pressure-transmitting medium provides cushioning progressively, thereby causing tension in flexible and relatively inelastic sides of a shoe sole. These compartments of the shoe sole provide support and cushioning similar in structure to the fat pads of the natural human foot, which simultaneously provide both firm support and progressive cushioning.

Existing cushioning systems cannot provide both firm support and progressive cushioning without also obstructing the natural pronation and supination motion of the foot. This is because the overall concept on which existing shoe cushioning systems are based is inherently flawed. For example, existing shoe cushioning systems do not provide adequate control of foot motion or stability. Conventional systems are generally augmented with rigid structures on the sides of the shoe uppers and the shoe soles, like heel counters and motion control devices, in order to provide control and stability. Unfortunately, these rigid structures seriously obstruct natural pronation and supination motion and actually increase lateral instability.

In marked contrast to the rigid-sided designs, the human foot provide stability at it sides by putting those sides, which are flexible and relatively inelastic, under extreme tension. The tension is caused by the pressure of compressed fat pads, wherein the fat pads become temporarily rigid when outside forces make that rigidity appropriate, thereby producing none of the destabilizing lever arm torque problems of the permanently rigid sides of existing shoe sole designs.

Among other objects, this invention attempts, as closely as possible, to replicate features of the naturally effective structures of the human foot that provide stability, support, and cushioning.

This and other objects of the invention will become apparent from a detailed description of the invention which follows taken with the accompanying drawings.

BRIEF DESCRIPTION OF THE DRAWINGS

FIGS. 8A through 8D illustrate sequentially a frontal plane cross section of a human heel at the ankle joint area, from an unloaded condition to a loaded, tilted condition, wherein FIG. 8A is unloaded and upright, FIG. 8B is moderately loaded by full body weight and upright, FIG. 8C is heavily loaded at peak landing force while running and upright, and FIG. 8D is heavily loaded and tilted out laterally to its about 20 degree maximum;

FIGS. 9A through 9D illustrate a frontal plane cross section of a shoe sole in accordance with a second embodiment of the present invention, wherein FIG. 9A illustrates the shoe sole unloaded and upright, FIG. 9B illustrates the shoe sole moderately loaded by full body weight and upright, FIG. 9C illustrates the shoe sole heavily loaded at peak landing force while running and upright, and FIG. 9D illustrates the shoe sole heavily loaded and tilted out laterally to about 20 degrees;

DETAILED DESCRIPTION OF THE PREFERRED EMBODIMENTS

Figure 1:
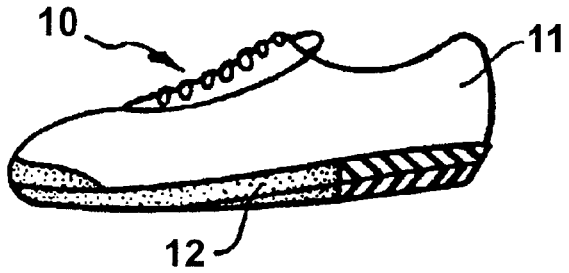
FIG. 1 (PRIOR ART)
FIG. 1 is a perspective view of a conventional athletic running shoe.

FIG. 1 shows a perspective view of a conventional athletic running shoe 10. Running shoe 10 includes a shoe sole upper portion 11 attached to a shoe sole 12.

Figure 2:
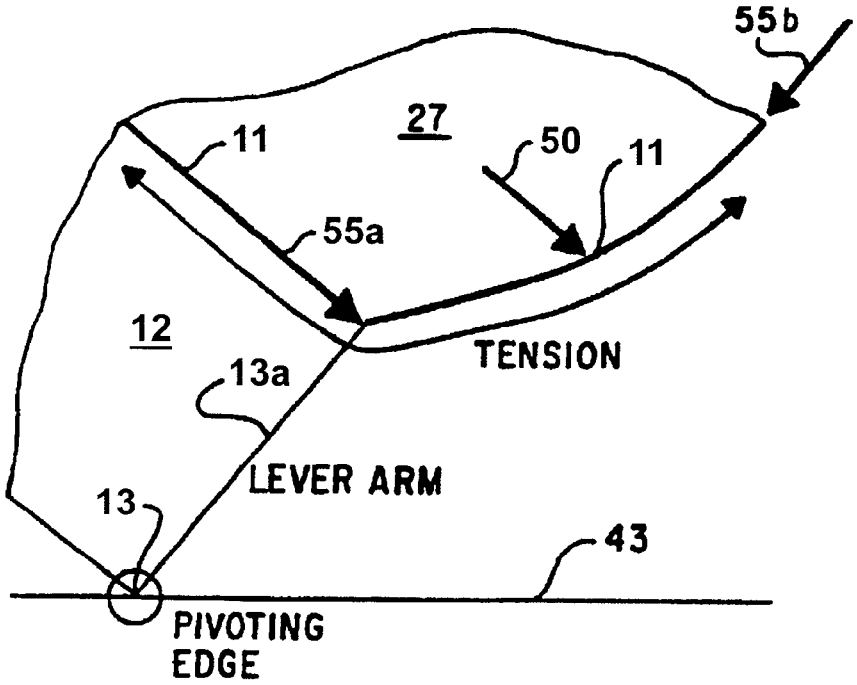
FIG. 2 (PRIOR ART)
FIG. 2 illustrates an enlarged portion of the conventional shoe of FIG. 1, as viewed in a heel area frontal plane at the ankle joint, the sole being undeformed by body weight and tilted sideways on its bottom edge.

FIG. 2 illustrates an enlarged view of a frontal plane cross section of a side of conventional shoe sole 12 of FIG. 1. Shoe sole 12 of FIG. 2 is shown undeformed by body weight and tilted on the ground 43 at a sole outer edge 13. FIG. 2 exemplifies an inherent stability problem in conventional shoe sole designs. Shoe upper 11 (shown in thickened and darkened lines) of shoe 10 creates unnatural destabilizing torque about shoe sole 12. This destabilizing torque is due to the forces of the shoe wearer tilting the shoe to the side. A tension force (indicated by arrow 55*a*) along the inner surface of shoe sole 12 is caused by a resultant compression force (indicated by arrow 50) of the force of gravity on the shoe wearer's body and a sideways motion force of the shoe wearer's foot 27. The destabilizing torque acts to pull the shoe sole in rotation around a lever arm 13*a* extending from pivot point (sole outer edge 13), wherein lever arm 13*a* has a length corresponding to the height of the shoe sole side edge. Accordingly, the force of wearer's foot 27 on shoe upper 11 tends to pull shoe sole 12 over on its side when the foot 27 is tilted sideways.

Figure 3:
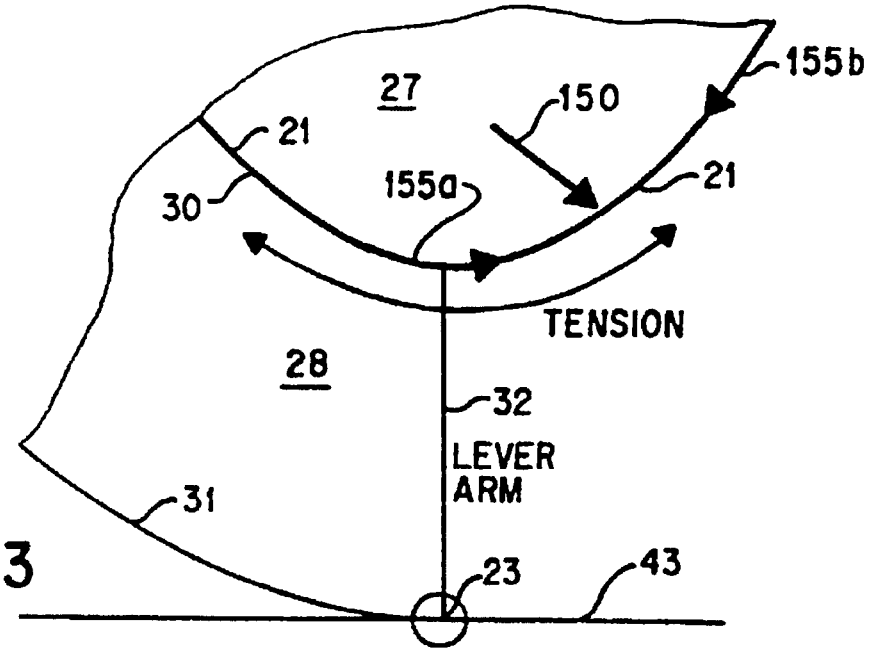
FIG. 3 illustrates an enlarged portion of a shoe sole in the same heel area frontal plane cross section as FIG. 2, the shoe sole tilted out similar to the sole shown in FIG. 2, but formed in accordance with Applicant's naturally contoured shoe sole design.

FIG. 3 illustrates an enlarged view of a frontal plane cross section of a side of a shoe sole according to Applicant's naturally contoured shoe sole 28. Applicant's naturally contoured shoe sole design is described in U.S. patent application Ser. No. 07/239,667, filed on Sep. 2, 1988, now U.S. Pat. Nos. 5,317,819 and 5,544,429, and includes a concavely rounded inner shoe sole surface portion 30 and a concavely rounded outer shoe sole surface portion 31, the concavities existing with respect to a wearer's foot 27. When tilted on a sole outer edge 23, the naturally contoured shoe sole 28 exhibits the same inherent stability as described above in conventional shoes, although to a reduced degree. The instability is reduced as compared to conventional shoe soles because the direction of a force vector 155*a* along the lower surface of the shoe upper 21 is parallel to the ground 43 at the sole outer edge 32. This is in contrast to the force vector 55*a* angled toward the ground, as shown in FIG. 2. Accordingly, unlike conventional shoe sole designs, the resulting torque produced about sole outer edge 23 of the naturally contoured shoe sole 28 provides direct structural support to the wearer's foot when tilted.

Figure 4:
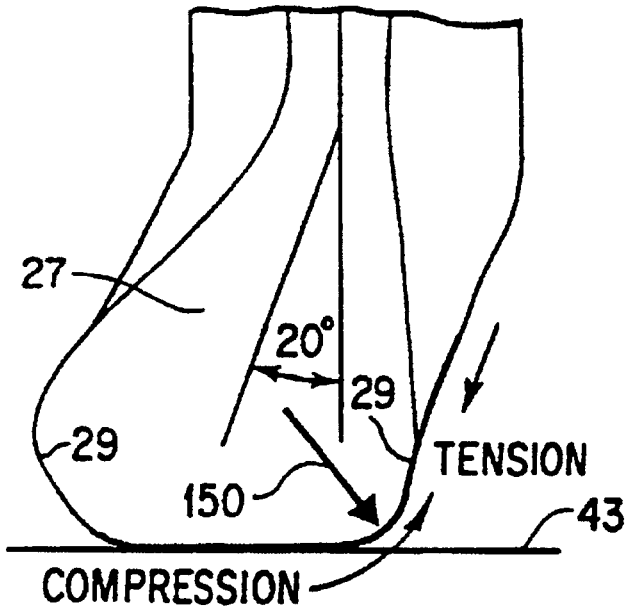
FIG. 4 illustrates a rear view of a heel of a human foot tilted laterally 20 degrees and under body weight load.

FIG. 4 illustrates the naturally stable dynamics of a bare human foot 27 when tilted under body weight load. Bare foot 27 is naturally stable because, when deformed by body weight and tilted to its natural lateral limit of about 20 degrees, a destabilizing torque is not created. Although tension forces similar to those described above in connection with FIGS. 2 and 3 exist at the outer surface 29 of foot 27, the resultant compression force (indicated by arrow 150) of gravity and sideways movement forces acts directly into ground 43. Consequently, the forces produced while tilting the loaded foot 27 do not create the unnatural lever arm described above. The weight of the human body firmly anchors outer surface 29 of foot 27 underneath the foot so that even considerable pressure against outer surface 29 of the side of the foot results in no destabilizing motion. When foot 27 is tilted, the supporting structures of the foot, like the calcaneus, slide against the side of the strong but flexible outer surface 29 of the foot and thereby create very substantial pressure on outer surface 29 at the sides of the foot. The pressure, however, is precisely resisted and balanced by tension existing along outer surface 29 of the foot 27, thereby resulting in a stable equilibrium.

Figure 5A:
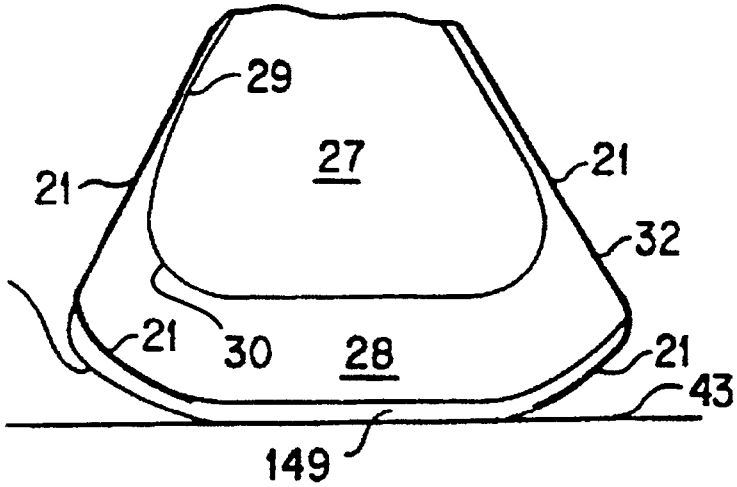
FIG. 5A illustrates a heel area frontal plane cross section of a shoe sole in accordance with a first embodiment of the present invention.
Figure 5B:
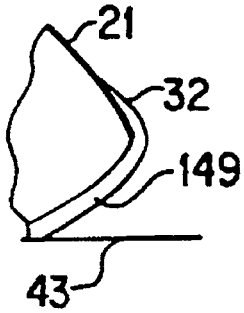
FIG. 5B illustrates an alternative aspect of the shoe sole of FIG. 5A, in accordance with the first embodiment of the present invention.
Figure 6:
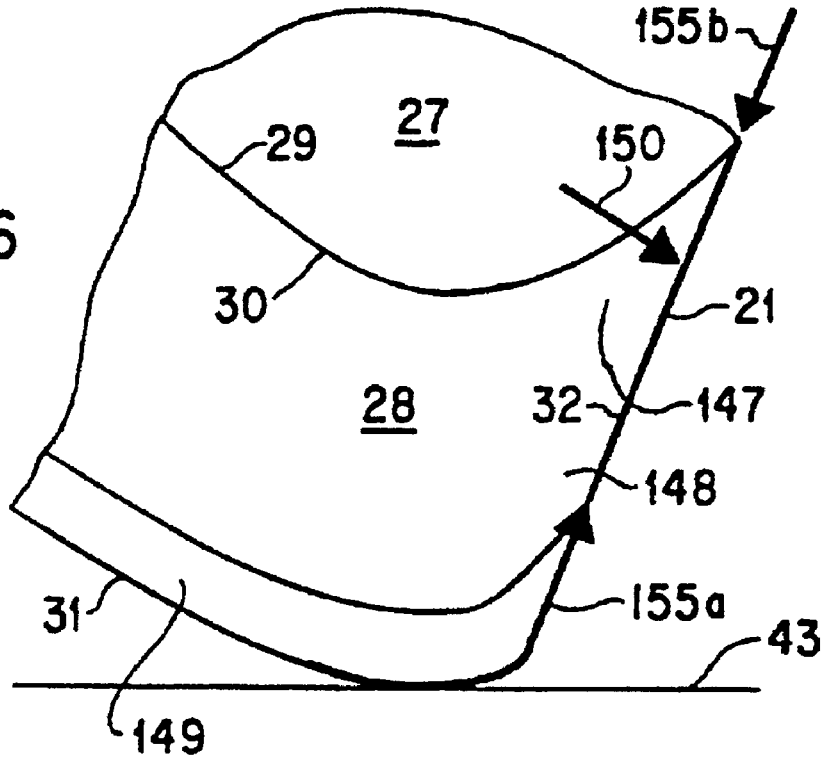
FIG. 6 illustrates a portion of a side of the shoe sole of FIG. 5A when tilted and unloaded.
Figure 7:
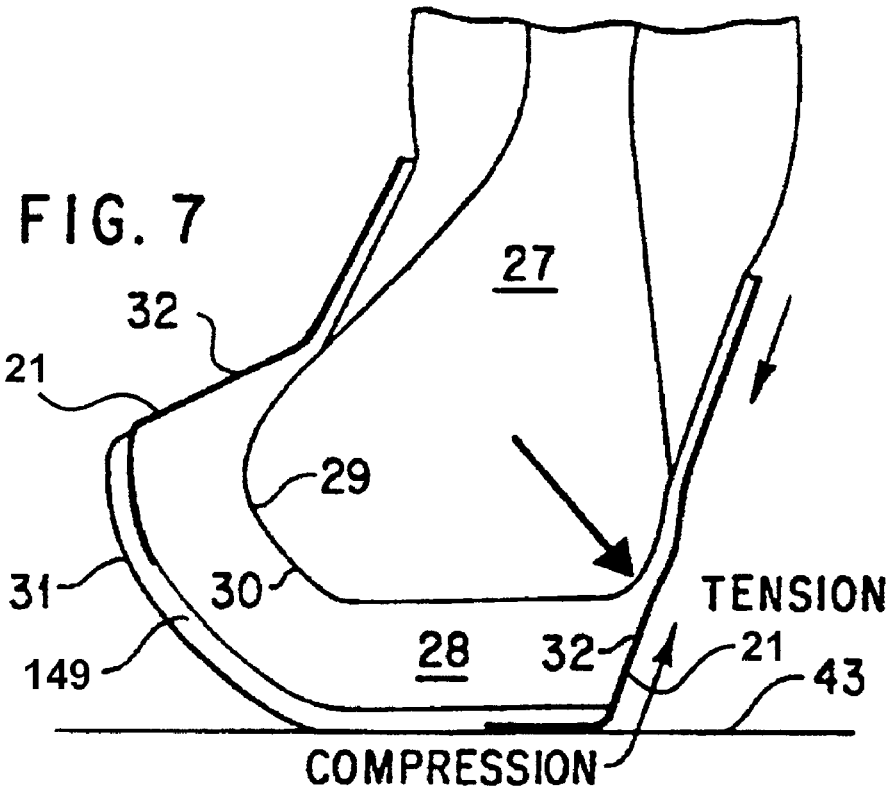
FIG. 7 illustrates the shoe sole of FIG. 5A when tilted and naturally deformed by body weight.

FIGS. 5–7 illustrate a first embodiment of the present invention incorporating tension stabilized sides to a naturally contoured shoe sole portion.

FIG. 5 illustrates a shoe sole in a frontal plane cross section at a heel area deformed under body weight, the shoe sole including tension stabilized sides (similar to those of the bare foot 27—FIG. 4) and the naturally contoured shoe sole design with concavely rounded inner shoe sole surface portion 30 and concavely rounded outer shoe sole surface portion 31, as described above in FIG. 3. The tension stabilized sides principle can be applied to conventional shoes (i.e. non-naturally contoured shoe sole designs), but is not shown. According to this embodiment of the present invention, shoe upper 21 (shown as darkened lines) wraps around the sole outer edge 32 of shoe sole 28, instead of attaching underneath the foot to an inner surface of the shoe sole, as is done conventionally. Shoe upper 21 can overlap and be attached to either the inner surface of the bottom sole 149 (as shown on the left side of FIG. 5), or the outer surface of bottom sole 149 (as shown on the right side of FIG. 5). Alternatively, and as shown in FIG. 5B, bottom sole 149 is formed thin and tapering as shown, so that it can extend upward around the outer edge 32 of the shoe sole to overlap and attach to shoe upper 21.

According to this first embodiment of the present invention, shoe upper 21 coincides with the Theoretically Ideal Stability Plane so that the tension force on the shoe sides is transmitted directly all the way down to bottom sole 149, which anchors it on the ground with virtually no intervening artificial lever arm. For shoes with only one sole layer, the attachment of shoe upper 21 should be at or near the lower or bottom surface of the shoe sole.

The shoe sole design according to the first embodiment is based on a fundamentally different concept than conventional shoe soles, that shoe upper 21 is integrated into shoe sole 28, instead of attached on top of it (FIGS. 1 and 2), so that the shoe sole acts as a natural extension of foot 27, not as a separate attachment to the foot.

Shoe sole upper 21 may be formed of fabric or other flexible material, like leather. The fabric would preferably be non-stretch or relatively so, so as not to be deformed excessively by the tension placed upon its sides when compressed as the foot and shoe tilt. The fabric can be reinforced in areas of particularly high tension, like the essential structural support and propulsion elements of the foot (i.e. the base and lateral tuberosity of the calcaneus, the base of the fifth metatarsal, the heads of the metatarsals, and the first distal phalange). The reinforcement of shoe upper 21 can take many forms, such as like that of corners of the jib sail of a racing sailboat or more simple straps. As closely as possible, shoe upper 21 should have the same performance characteristics as the heavily calloused skin of the sole of a bare foot. A shoe sole with relative density is preferred, with the softest density of the shoe sole nearest the foot sole, so that the conforming sides of the shoe sole do not provide a rigid destabilizing lever arm.

According to the present invention and as shown in FIG. 5, shoe upper 21 is directly integrated functionally with shoe sole 28, instead of simply being attached on top of it. An advantage of the tension stabilized sides design includes providing natural stability as close to that of the barefoot as possible, while doing so economically with the minimum shoe sole side width possible.

FIG. 6 illustrates an enlarged view of a portion of a sole side of the shoe sole of FIG. 5A when tilted and unloaded (undeformed by body weight). The destabilizing force occurring in conventional shoe soles is stably resisted in shoe sole 28 according to the present invention. The stability results from offsetting tension forces 155*a* and 155*b* in the surface of shoe upper 21 extended down the side of the shoe sole so that the sole side is anchored by the weight of the body when the shoe and foot are tilted.

In order to avoid creating unnatural torque on shoe sole 28, shoe upper 21 may be joined or bonded only to the bottom sole 149, not the midsole 148. This assures that pressure shown on the side of shoe upper 21 produces side tension only and not the destabilizing torque described in connection with conventional shoe soles of FIG. 2 above. However, to avoid unnatural torque, the upper areas 147 of the shoe midsole 148, which forms a sharp corner, should be composed of relatively soft midsole material. Bottom sole 149 is preferably thin, at least on the stability sides, so that its attachment overlaps with the shoe upper 21 as close as possible to the Theoretically Ideal Stability Plane. Such an arrangement allows the forces to be transmitted on the outer shoe sole surface to the ground.

In summary, according to the present invention and FIG. 5A, a shoe includes a shoe upper 21 that is composed of material that is flexible and relatively inelastic, at least where shoe upper 21 contacts the areas of the structural bone elements of the human foot, and a shoe sole 28 that has relatively flexible sides, and at least a portion of the sides of shoe upper 21 are attached directly to bottom sole 149, while enveloping on the outside the other sole portions of shoe sole 28. This construction can either be applied to convention shoe sole structures or to a naturally contoured shoe sole conforming to the theoretically ideal stability plane.

FIG. 7 shows, in frontal plane cross section at the heel, the tension stabilized sides concept of the present invention applied to naturally contoured shoe sole 28 when the shoe and foot are tilted out fully and naturally deformed by body weight (although constant shoe sole thickness is shown undeformed). The figure shows that the shape and stability function of shoe sole 28 and shoe upper 21 mirror almost exactly the shape and stability function of the human foot.

Figure 8A:
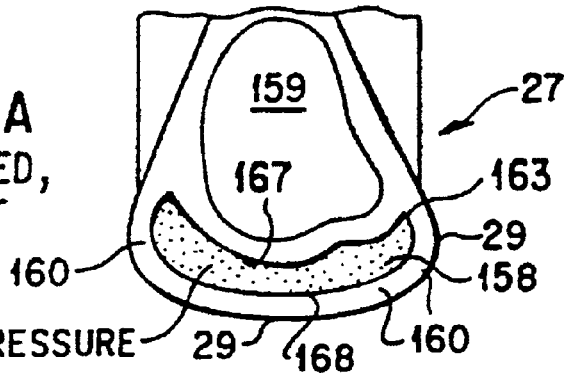
Figure 8B:
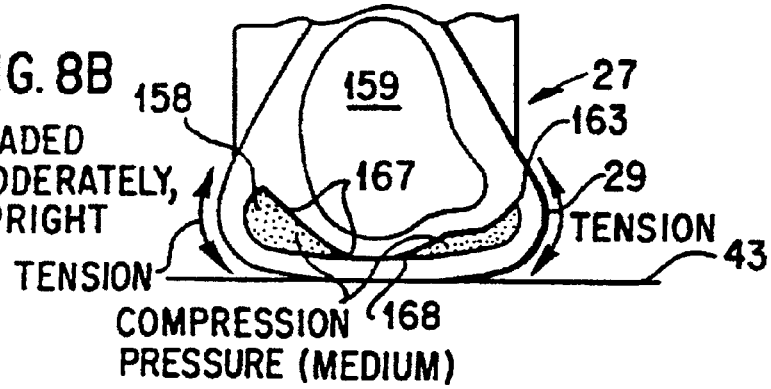

FIGS. 8A–8D illustrate sequentially the natural cushioning of a bare human foot 27, as viewed in a frontal plane cross section at the heel. FIG. 8A shows the bare heel upright and unloaded, with little pressure on the subcalcaneal fat pad 158, which is evenly distributed between the calcaneus (heel bone) 159 and the bottom sole 160 of foot 27. FIG. 8B shows the bare heel upright but under moderate pressure of full body weight. The compression of calcaneus 159 against subcalcaneal fat pad 158 produces evenly balanced pressure within subcalcaneal fat pad 158 because it is contained and surrounded by a relatively unstretchable fibrous capsule, the bottom sole 160 of the foot. Underneath foot 27, where the bottom sole is in direct contact with ground 43, the pressure caused by calcaneus 159 on compressed subcalcaneal fat pad 158 is transmitted directly to ground 43. Simultaneously, substantial tension is created on the sides of the bottom sole of the foot because of the surrounding relatively tough fibrous capsule. That combination of bottom pressure and side tension is the foot's natural shock absorption system for support structures like calcaneus 159 and the other bones of the foot that come in contact with ground 43.

Of equal functional importance is that a lower surface 167 of the support structures of the foot, like calcaneus 159 and other bones, make firm contact with the upper surface 168 of the foot's bottom sole so that relatively little uncompressed fat pad intervenes between surfaces 167 and 168. In effect, when the support structures of foot 27 land on the ground they are firmly supported, not suspended on top of springy material in a buoyant manner analogous to a water bed or pneumatic tire. This simultaneously firm yet cushioned support provided by the sole of foot 27 has a significantly beneficial impact on energy efficiency, also called energy return, and is not paralleled by existing shoe designs. In contrast, conventional shoe soles provide shock absorption cushioning during the landing and support phases of locomotion at the expense of firm support during the take-off phase.

Figure 8C:
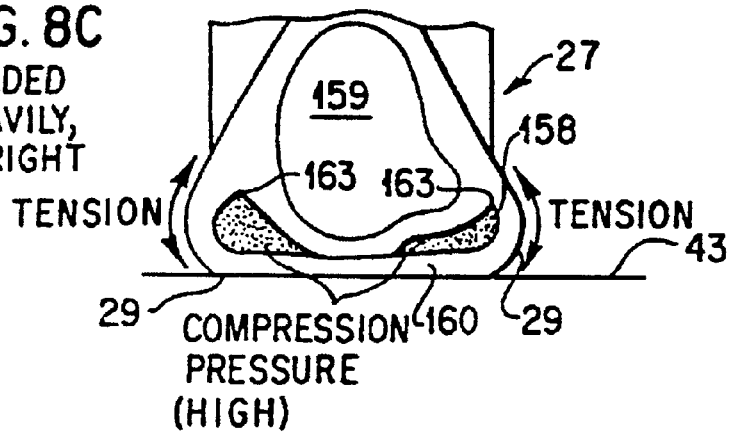

The incredible and unique feature of the foot's natural system is that, once calcaneus 159 is in fairly direct contact with bottom sole 160 and therefore providing firm support and stability, increased pressure produces a more rigid fibrous capsule that protects calcaneus 159 and greater tension at the foot sides to absorb shock. So, in a sense, even when the foot's suspension system would seem in a conventional way to have bottomed out under normal body weight pressure, it continues to react with a mechanism to protect and cushion the foot even under very much more extreme pressure. This is seen in FIG. 8C, which shows the human heel under the heavy pressure of roughly three times body weight force of landing during routine running. This can be easily verified by standing barefoot on a hard floor, wherein the heel feels very firmly supported and yet can be lifted and virtually slammed onto the floor with little increase in the feeling of firmness. The heel simply becomes harder as the pressure increases.

In addition, it should be noted that the natural foot allows the relatively narrow base of calcaneus 159 to pivot from side to side freely in normal pronation/supination motion, without any obstructing torsion. This is despite the very much greater width of compressed foot sole providing protection and cushioning. This aspect is crucially important in maintaining natural alignment of joints above the ankle joint such as the knee, hip and back, particularly in the horizontal plane, so that the entire body is properly adjusted to absorb shock correctly. In contrast, existing shoe sole designs, which are generally relatively wide to provide stability, produce unnatural frontal plane torsion on the calcaneus. This unnatural torsion restricts natural motion of the calcaneus, thereby causing misalignment of the joints operating above it. Such misalignment can result in the overuse injuries unusually common with wearers of conventional shoes. Instead of flexible sides that harden under tension caused by pressure like that of the foot, existing shoe sole designs are forced by lack of other alternatives to use relatively rigid sides in an attempt to provide sufficient stability to offset the otherwise uncontrollable buoyancy and lack of firm support of conventional sole cushions.

Figure 8D:
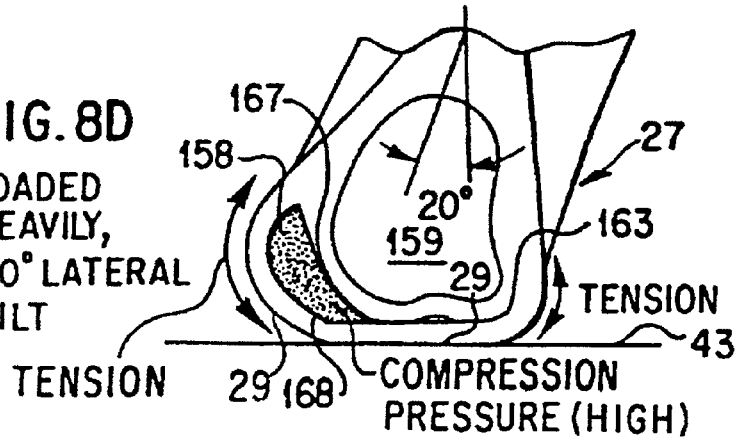

FIG. 8D shows the foot 27 deformed under full body weight and tilted laterally to the roughly 20 degree limit of normal range. Again it is clear that the natural system provides both firm lateral support and stability by providing relatively direct contact with the ground, while at the same time providing a cushioning mechanism through side tension and subcalcaneal fat pad pressure.

FIGS. 9A through 9D illustrate in a frontal plane cross section at the heel, a naturally contoured shoe sole design according to a second embodiment of the present invention. This embodiment parallels as closely as possible the overall natural cushioning and stability system of the natural foot described in connection with FIGS. 8A–8D. Consequently, FIGS. 9A–9D directly correspond to FIGS. 8A–8D.

Figure 9A:
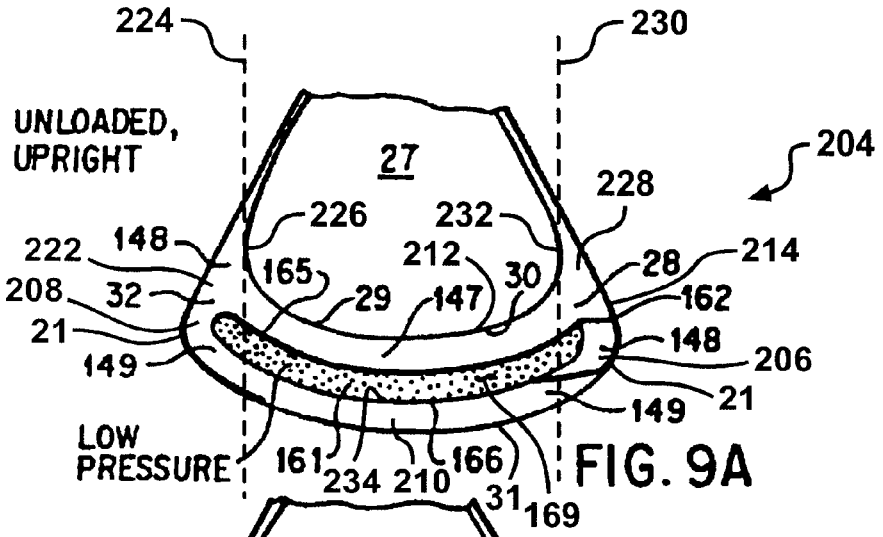
Figure 9B:
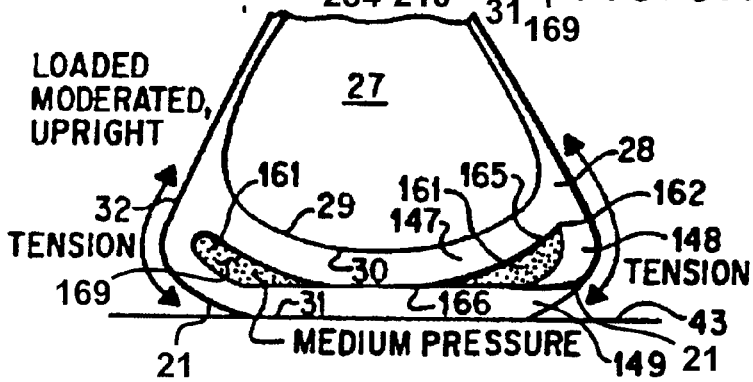

As seen in FIG. 9A, the shoe sole 28 according to this embodiment includes a cushioning compartment 161 under support structures of the foot. Cushioning compartment 161 contains a pressure-transmitting medium 169 like gas, gel, or liquid. Cushioning compartment 161 is like the subcalcaneal fat pad under the calcaneus and other bones of the natural foot. The optimal pressure-transmitting medium 169 for cushioning compartment 161 is that which most closely approximates the fat pads of the foot. Silicone gel is probably the most optimal material currently readily available for use as pressure-transmitting medium 169, but future improvements in material engineering may uncover better medium. Gas is significantly less optimal as pressure-transmitting medium 169. The gas, gel, or liquid, or any other effective material, can be further encapsulated itself, in addition to encapsulation provided by the sides of shoe sole 28. Such further encapsulation would control leakage and maintain uniformity. Cushioning compartment 161 can also be subdivided into any practical number of encapsulated areas within compartment 161. The relative thickness of cushioning compartment 161 can vary, as can bottom sole 149 and upper midsole 147, and can be consistent or differ in various areas of the shoe sole. The optimal relative size of compartment 161 approximates most closely those of the average human foot, which suggests both smaller upper and lower soles and a larger cushioning compartment than shown in FIGS. 9A–9D. However, for ease of manufacturing and other reasons, cushioning compartment 161 can also be very thin, including as thin as a simple sipe or horizontal slit, or a single boundary layer, such as a portion or most of that layer between bottom sole 149 and midsole 148. Cushioning compartments 161 can be placed anywhere from directly underneath the foot, like an insole, to directly above bottom sole 149. Optimally, the amount of compression created by a given load in any cushioning compartment 161 should be tuned to approximate as closely as possible the compression existing under the corresponding fat pad of the natural foot.

The function of the natural subcalcaneal fat pad is not met satisfactorily with existing proprietary cushioning systems, even those featuring gas, gel or liquid as a pressure transmitting medium. In contrast to those artificial systems, the present invention conforms to the natural contour of the foot and to the natural method of transmitting bottom pressure into side tension in the flexible but relatively non-stretching (the actual optimal elasticity will require empirical studies) sides of the shoe sole.

Figure 9C:
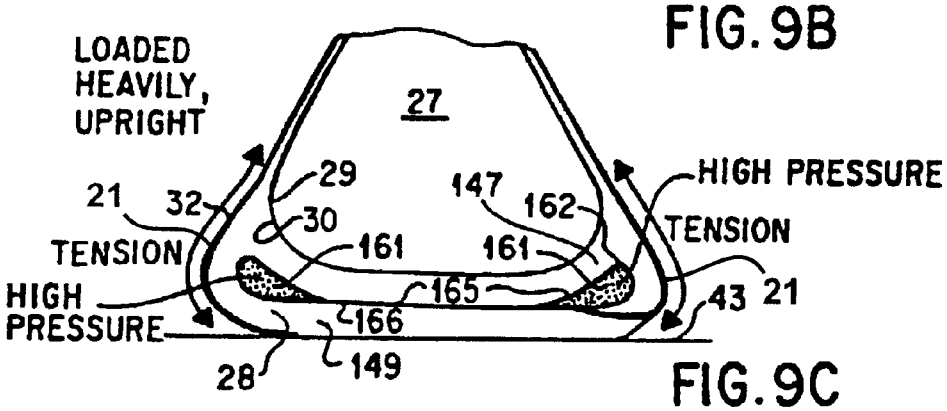

Existing cushioning systems do not bottom out under moderate loads and rarely if ever do so under extreme loads. Restated, the upper surface of the conventional cushioning devices remain suspended above the lower surface thereof. In contrast, the shoe sole of FIG. 9A provides firm support to support structures of the foot by providing for actual contact between lower surface 165 of upper midsole 147 and upper surface 166 of bottom sole 149 when fully loaded under moderate body weight pressure. See FIG. 9B. Contact of surfaces 165 and 166 also occurs under maximum normal peak landing forces during running, as indicated in FIG. 9C. Surfaces 165 and 166 act just as the human foot does in FIGS. 8B and 8C. The greater the downward force transmitted through the foot to the shoe, the greater the compression pressure in cushioning compartment 161, and the greater the resulting tension of the shoe sole sides.

Figure 9D:
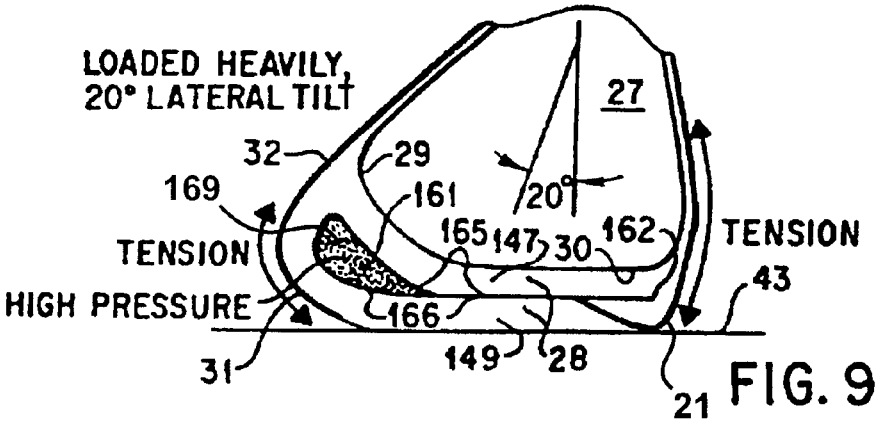

FIG. 9D shows shoe sole 28 fully loaded and tilted to the natural 20 degree lateral limit. FIG. 9D also illustrates an added stability benefit of the present invention, that the effective thickness of the shoe sole is reduced by compression of the sole side so that the potential destabilizing lever arm represented by the shoe sole thickness is reduced. Another benefit of the present invention is that upper midsole 147 shoe surface can move in any horizontal direction, either sideways or front to back in order to absorb shearing forces. Such shearing motion is controlled by tension in the sole sides. Note that the right side of FIGS. 9A–9D illustrates compartment 161 with a natural crease or upward taper 162, which allows complete side compression without binding or bunching between the upper and lower shoe sole layers 147, 148, and 149. Crease 162 parallels exactly a similar crease or taper 163 in the human foot (FIGS. 8A–8D).

According to the present invention, a shoe having a shoe sole (28) suitable for an athletic shoe comprises a sole inner surface (30) for supporting a foot of an intended wearer (27), outer surface (31) and a heel portion (204) at a location substantially corresponding to the location of a heel of the intended wearer's foot (27) when inside the shoe. The shoe sole (28) further comprises a sole medial side (206), a sole lateral side (208) and a sole middle portion (210) located between said sole sides, a midsole component (147, 148) having an inner surface (212) and an outer surface (214), and a bottom sole (149) which forms at least part of the sole outer surface (31). The sole outer surface (31) of one of the sole medial and lateral sides (206, 208) comprising a concavely rounded portion extending below a lowest point of the inner surface of the midsole component (212) and down to at least an uppermost point of a bottom sole portion, as viewed in said heel portion frontal plane cross-section when the shoe sole (28) is upright and in an unloaded condition, the concavity of the concavely rounded portion of the sole outer surface (31) existing with respect to an inner section of the shoe sole (28) directly adjacent to the concavely rounded portion of the sole outer surface (31). The sole (28) further having a lateral sidemost section (222) located outside a straight vertical line (224) extending through the shoe sole (28) at a lateral sidemost extent (226) of an inner surface of the midsole component (147, 148), as viewed in said heel portion frontal plane cross-section when the shoe sole (28) is upright and in an unloaded condition, and a medial sidemost section (228) located outside a straight vertical line (230) extending through the shoe sole at a medial sidemost extent (232) of an inner surface of the midsole component (147,148), as viewed in said heel portion frontal plane cross-section when the shoe sole is upright and in an unloaded condition. The shoe sole (28) further comprises at least one cushioning compartment (161) located between the sole inner surface (30) and the sole outer surface (31) of the heel portion. The at least one cushioning compartment (161) including one of a gas, gel, or liquid, and being defined by an outer surface (234) comprising a concavely rounded portion, as viewed in said heel portion frontal plane cross-section when the shoe sole (28) is upright and in an unloaded condition, the concavity of the concavely, rounded portion of the outer surface which defines the at least one cushioning compartment (161) existing with respect to inside each respective cushioning compartment (161).

Another possible variation of joining shoe upper 21 to shoe bottom sole 149 is illustrated on the right (lateral) side of FIGS. 9A–9D. This variation makes use of the fact that it is optimal for the tension absorbing shoe sole sides, whether shoe upper or bottom sole, to coincide with the Theoretically Ideal Stability Plane along the side of the shoe sole beyond that point reached when the shoe is tilted to the foot's natural limit. This assures that no destabilizing shoe sole lever arm is created when the shoe is tilted fully, as in FIG. 9D. The joining location of shoe upper 21 and bottom sole 149 may be moved up slightly so that the fabric side of shoe upper 21 does not come in contact with the ground, or it may be covered with a coating to provide both traction and fabric protection.

It should be noted that the present invention provides a structural basis for the shoe sole to conform very easily to the natural shape of the human foot and to parallel easily the natural deformation flattening of the foot during load-bearing motion on the ground. This is true even if the shoe sole is made like a conventional sole except for the present invention, although relatively rigid structures such as heel counters and motion control devices are not preferred since they would interfere with the capability of the shoe sole to deform in parallel with the natural deformation under load of the wearer's foot sole. Though not optimal, such a conventional flat shoe made with the aspects of the present invention would provide significantly improved cushioning and stability. The present invention could also be applied to intermediate shaped shoe soles that neither conform to the flat ground or the naturally contoured foot.

In summary, according to the second embodiment of the present invention, a shoe includes a shoe sole 28 with a compartment or compartments 161 under the structural elements of the human foot, including at least the heel. Compartment or compartments 161 contain a pressure-transmitting medium 169 like liquid, gas, or gel, a portion of upper surface 165 of compartment 161 firmly contacts the lower surface 166 of compartment 161 during normal load-bearing, and pressure from the load-bearing is transmitted progressively at least in part to the relatively inelastic sides, top and bottom of shoe sole compartment or compartments 161, producing tension.

Figure 10A:
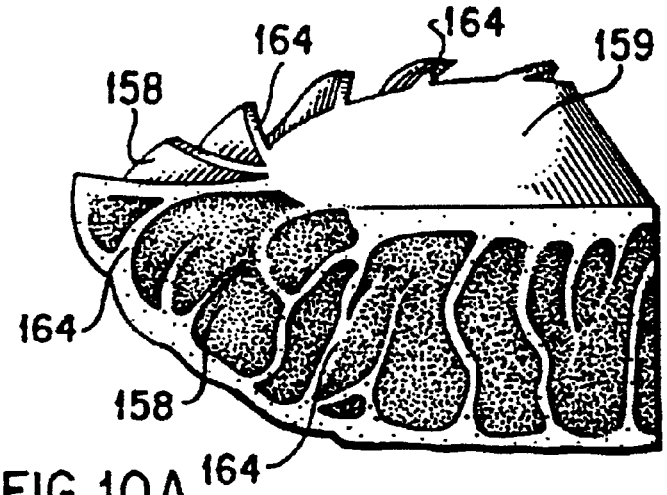
FIG. 10A illustrates the structure of fibrous connective tissue forming fat pad chambers existing below a section of the calcaneus of a human foot.
Figure 10B:
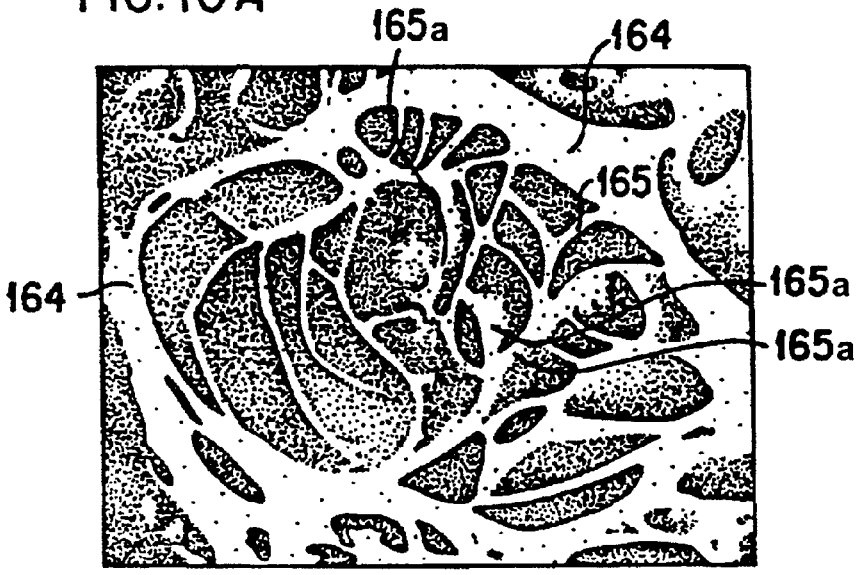
FIG. 10B illustrates a close-up view of a fat pad chamber of the human foot.
Figure 10C:
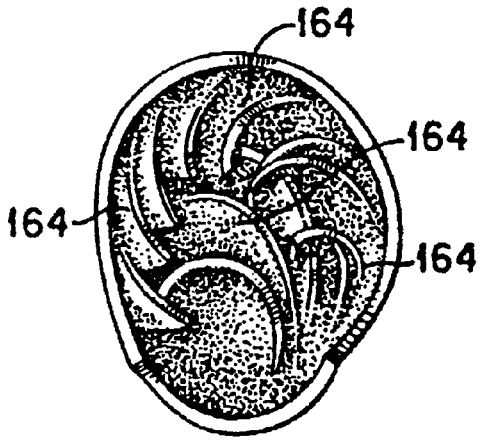
FIG. 10C illustrates a horizontal section of a whorl arrangement of a fat pad underneath the calcaneus of the human foot.

While the FIG. 9 design copies in a simplified way the macro structure of the foot, FIGS. 10A–10C focus on the micro structure of the natural structures of the foot 27. FIGS. 10A and 10C are perspective views of cross sections of the human heel showing the matrix of elastic fibrous connective tissue arranged into chambers 164 holding closely packed fat cells; the chambers are structured as whorls radiating out from the calcaneus 159. These fibrous-tissue strands are firmly attached to the undersurface of calcaneus 159 and extend to the subcutaneous tissues. They are usually in the form of the letter U, with the open end of the U pointing toward the calcaneus 159.

As the most natural, an approximation of the specific chamber structure of FIGS. 10A–10C would appear to be the most optimal as an accurate model for the structure of the shoe sole cushioning compartments 161. Although the complicated nature of the natural design will require some time to overcome exact design and construction difficulties, the description of the structure of calcaneal padding provided by Erich Blechschmidt in Foot and Ankle, March, 1982, (translated from the original 1933 article in German) is so detailed and comprehensive that copying the same structure as a model in shoe sole design is not difficult technically. Other arrangements and orientations of the whorls are possible, but would probably be less optimal.

Pursuing this nearly exact design analogy, the lower surface 165 of the upper midsole 147 would correspond to the outer surface 167 of the calcaneus 159 and would be the origin of the U shaped whorl chambers 164 noted above.

FIG. 10B shows a close-up of the interior structure of the large chambers shown in FIG. 10A and 10C. It is clear from the fine interior structure and compression characteristics of the mini-chambers 165*a* that those directly under the calcaneus become very hard quite easily. This is due to the high local pressure on them and the limited degree of elasticity. Accordingly, mini-chambers 165*a* are able to provide very firm support to the calcaneus or other bones of the foot sole. By being fairly inelastic, the compression forces on mini-compartments 165*a* are dissipated to other areas of the network of fat pads under any given support structure of the foot, like the calcaneus. Consequently, if cushioning compartment 161, such as compartment 161 under the heel shown in FIG. 9A, is subdivided into smaller chambers, like those shown in FIG. 10B, then actual contact between upper surface 165 and lower surface 166 of compartment 161 would no longer be required to provide firm support, so long as compartments 161 and pressure-transmitting medium 169 contained in them have material characteristics similar to those of the foot. As described above, the use of gas may not be satisfactory in this approach since its compressibility may not allow adequate firmness.

In summary, according to the present invention as envisioned in FIGS. 10A–10C, shoe includes a shoe sole with a compartment under the structural elements of the human foot, including at least the heel, the compartments contain a pressure-transmitting medium like liquid, gas, or gel, and have a whorled structure like that of the fat pads of the human foot sole. Load-bearing pressure is transmitted progressively at least in part to the relatively inelastic sides, top and bottom of the shoe sole compartments, thereby producing tension therein. The elasticity of the material of the compartments and the pressure-transmitting medium are such that normal weight-bearing loads produce sufficient tension within the foot, with different grades of coarseness available, from fine to coarse, corresponding to feet from soft to naturally tough. Using a tube sock design with uniform coarseness, rather than conventional sock design assumed above, would allow the user to rotate the sock on his foot to eliminate any "hot spot" irritation points that might develop. Also, since the toes are most prone to blistering and the heel is most important in shock absorption, the toe area of the sock could be relatively less abrasive than the heel area.

What is claimed is:

1. A shoe having a shoe sole suitable for an athletic shoe, the shoe sole comprising:

a sole inner surface for supporting a foot of an intended wearer;

a sole outer surface;

a heel portion at a location substantially corresponding to the location of a heel of the intended wearer's foot when inside the shoe;

the shoe sole having a sole medial side, a sole lateral side and a sole middle portion located between said sole sides;

a midsole component having an inner surface and an outer surface;

a bottom sole which forms at least part of the sole outer surface;

the inner surface of the midsole component of one of the sole medial and lateral sides comprising a convexly rounded portion, as viewed in a heel portion frontal plane cross-section when the shoe sole is upright and in an unloaded condition, the convexity of the convexly rounded portion of the inner surface of the midsole component existing with respect to a section of the midsole component directly adjacent to the convexly rounded portion of the inner surface of the midsole component, the sole outer surface of one of the sole medial and lateral sides comprising a concavely rounded portion located below a height of a lowest point of the inner surface of the midsole component and extending down to at least a height of an uppermost point of the bottom sole, as viewed in said heel portion frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface, the convexly rounded portion of the inner surface of the midsole component and the sole outer surface concavely rounded portion both being located on the same sole side;

the sole having a lateral sidemost section located outside a straight vertical line extending through the shoe sole at a lateral sidemost extent of the inner surface of the midsole component, as viewed in said heel portion frontal plane cross-section when the shoe sole is upright and in an unloaded condition;

the sole having a medial sidemost section located outside a straight vertical line extending through the shoe sole at a medial sidemost extent of the inner surface of the midsole component, as viewed in said heel portion frontal plane cross-section when the shoe sole is upright and in an unloaded condition;

said uppermost point of the bottom sole portion and a portion of the midsole component extend into one of said sidemost sections of the shoe sole, as viewed in said heel portion frontal plane cross-section when the shoe sole is upright and in an unloaded condition;

said midsole portion located in a sidemost section of the shoe sole extending to a height above the lowest point of said inner surface of the midsole component, as viewed in said heel portion frontal plane cross-section when the shoe sole is upright and in an unloaded condition; and at least one cushioning compartment located between the sole inner surface and the sole outer surface of the heel portion, the at least one cushioning compartment including one of a gas, gel, or liquid, and being defined by an outer surface comprising a concavely rounded portion, as viewed in said heel portion frontal plane cross-section when the shoe sole is upright and in an unloaded condition, the concavity of the concavely rounded portion of the outer surface which defines the at least one cushioning compartment existing with respect to inside each respective cushioning compartment.

2. The shoe according to claim 1, wherein the sole outer surface concavely rounded portion extends substantially from a height above the lowest point of the inner surface of the midsole component substantially to said uppermost point of said bottom sole portion of said sole outer surface, as viewed in said heel portion frontal plane cross-section when the shoe sole is upright and in an unloaded condition.

3. The shoe according to claim 1, wherein the sole outer surface concavely rounded portion extends substantially from a sidemost extent of the sole outer surface substantially to at least said uppermost point of said bottom sole portion of said sole outer surface, as viewed in said heel portion frontal plane cross-section when the shoe sole is upright and in an unloaded condition.

4. The shoe according to claim 1, wherein the sole outer surface concavely rounded portion extends above the sidemost extent of the sole outer surface, as viewed in said heel portion frontal plane cross-section when the shoe sole is upright and in an unloaded condition.

5. The shoe according to claim 3, wherein the sole outer surface concavely rounded portion extends substantially from the sidemost extent of said sole outer surface of one sole side substantially to a sidemost extent of the sole outer surface of the other sole side, as viewed in said heel portion frontal plane cross-section when the shoe sole is upright and in an unloaded condition.

6. The shoe according to claim 1, wherein the cushioning compartment is encapsulated.

7. The shoe according to claim 1, wherein a portion of a shoe upper of the shoe envelops on the outside a part of the midsole portion.

8. The shoe according to claim 1, wherein the shoe is an athletic shoe.

9. The shoe sole according to claim 1, wherein the sole outer surface concavely rounded portion is formed by midsole extending up from the bottom sole portion, as viewed in said heel portion frontal plane cross-section when the shoe sole is upright and in an unloaded condition.

10. The shoe according to claim 1, wherein the outer surface which defines the at least one cushioning compartment comprises an upper surface portion and a lower surface portion, the upper and lower surface portions of said at least one cushioning compartment contacting when the shoe is fully loaded under moderate body weight pressure and when the shoe is subjected to maximum normal peak landing forces during running.

11. The shoe according to claim 1, wherein the concavely rounded portion of the sole outer surface extends substantially through a portion of the sole outer surface formed by the bottom sole portion, as viewed in said heel portion frontal plane cross-section when the shoe sole is upright and in an unloaded condition.

12. The shoe according to claim 1, wherein the at least one cushioning compartment extends into the shoe sole side having the convexly rounded portion of the inner surface of the midsole component and the concavely rounded sole outer surface portion, as viewed in said frontal plane cross-section when the shoe sole is upright and in an unloaded condition.

13. The shoe according to claim 1, wherein the convexly rounded portion of the inner surface of the midsole component is located at a peripheral edge of the inner surface of the midsole component, as viewed in said frontal plane cross-section when the shoe sole is upright and in an unloaded condition.

14. The shoe according to claim 1, wherein the outer surface of the midsole component comprises a concavely rounded portion, the concavity being determined relative to an inner section of the midsole component located directly adjacent to the concavely rounded outer surface portion of the midsole component, as viewed in a frontal plane cross-section when the shoe sole is upright and in an unloaded condition.

15. The shoe according to claim 1, wherein the concavely rounded portion of the sole outer surface extends substantially continuously to a boundary of the lateral sidemost section of the shoe sole, as viewed in a frontal plane cross-section when the shoe sole is upright and in an unloaded condition.

16. The shoe according to claim 1, wherein the concavely rounded portion of the sole outer surface extends substantially continuously to a boundary of the medial sidemost section of the shoe sole, as viewed in a frontal plane cross-section when the shoe sole is upright and in an unloaded condition.

17. The shoe according to claim 1, wherein the concavely rounded portion of the sole outer surface extends substantially continuously to both a boundary of the lateral sidemost section of the shoe sole, and a boundary of the medial sidemost section of the shoe sole, as viewed in a frontal plane cross-section when the shoe sole is upright and in an unloaded condition.

18. The shoe sole according to claim 1, wherein the concavely rounded portion of the sole outer surface extends substantially to a lowest point of the sole outer surface, as viewed in a frontal plane cross-section when the shoe sole is upright and in an unloaded condition.

19. A shoe according to claim 1, wherein said sole outer surface concavely rounded portion is located at said sole medial side, and said sole lateral side also includes a concavely rounded portion extending below a lowest point of the inner surface of the midsole component and down to at least an uppermost point of a bottom sole portion, as viewed in said heel portion frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface.

20. A shoe having a shoe sole suitable for an athletic shoe, the shoe sole comprising:

a sole inner surface for supporting a foot of an intended wearer;

a sole outer surface;

a heel portion at a location substantially corresponding to the location of a heel of the intended wearer's foot when inside the shoe;

the shoe sole having a sole medial side, a sole lateral side and a sole middle portion located between said sole sides;

a midsole component having an inner surface and an outer surface;

a bottom sole which forms at least part of the sole outer surface;

the inner surface of the midsole component of one of the sole medial and lateral sides comprising a convexly rounded portion, as viewed in a heel portion frontal plane cross-section when the shoe sole is upright and in an unloaded condition, the convexity of the convexly rounded portion of the inner surface of the midsole component existing with respect to a section of the midsole component directly adjacent to the convexly rounded portion of the inner surface of the midsole component, the sole outer surface of one of the sole medial and lateral sides comprising a concavely rounded portion extending at least from a height of an uppermost point of a bottom sole substantially continuously through and above a sidemost extent of said sole outer surface, as viewed in said heel portion frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface, the convexly rounded portion of the inner surface of the midsole component and the sole outer surface concavely rounded portion both being located on the same sole side;

the sole having a lateral sidemost section located outside a straight vertical line extending through the shoe sole at a lateral sidemost extent of the inner surface of the midsole component, as viewed in said heel portion frontal plane cross-section when the shoe sole is upright and in an unloaded condition;

the sole having a medial sidemost section located outside a straight vertical line extending through the shoe sole at a medial sidemost extent of the inner surface of the midsole component, as viewed in said heel portion frontal plane cross-section when the shoe sole is upright and in an unloaded condition;

a portion of the bottom sole and a portion of the midsole component extends into one of said sidemost sections of the shoe sole side, as viewed in said heel portion frontal plane cross-section when the shoe sole is upright and in an unloaded condition;

said midsole portion located in a sidemost section of the shoe sole extending to a height above a lowest point of said inner surface of the midsole component, as viewed in said heel portion frontal plane cross-section when the shoe sole is upright and in an unloaded condition; and at least one cushioning compartment located between the sole inner surface and the sole outer surface, as viewed in said heel portion frontal plane cross-section, and said at least one cushioning compartment including one of a gas, gel, or liquid.

21. The shoe according to claim 20, wherein the sole outer surface concavely rounded portion extends substantially from above the sidemost extent of said sole outer surface of one sole side substantially to a sidemost extent of the sole outer surface of the other sole side, as viewed in said heel portion frontal plane cross-section when the shoe sole is upright and in an unloaded condition.

22. The shoe according to claim 20, wherein the sole outer surface concavely rounded portion extends at least substantially from a height above the lowest point of the inner surface of the midsole component substantially to said uppermost point of said bottom sole portion on said sole side, as viewed in said heel portion frontal plane cross-section when the shoe sole is upright and in an unloaded condition.

23. The shoe according to claim 20, wherein said at least one cushioning compartment is defined by an outer surface having a concavely rounded portion, as viewed in a frontal plane cross-section when the shoe sole is upright and in an unloaded condition, the concavity of the concavely rounded portion of the outer surface which defines the at least one cushioning compartment existing with respect to inside each respective cushioning compartment.

24. The shoe according to claim 20, wherein the cushioning compartment is encapsulated.

25. The shoe according to claim 20, wherein a portion of a shoe upper of the shoe envelops on the outside a part of the midsole portion.

26. The shoe sole according to claim 20, wherein the sole outer surface concavely rounded portion extending up from said bottom sole portion is formed by midsole, as viewed in said heel portion frontal plane cross-section when the shoe sole is upright and in an unloaded condition.

27. The shoe according to claim 20, wherein the outer surface which defines the at least one cushioning compartment comprises an upper surface portion and a lower surface portion, the upper and lower surface portions of said at least one cushioning compartment contacting when the shoe is fully loaded under moderate body weight pressure and when the shoe is subjected to maximum normal peak landing forces during running.

28. The shoe according to claim 20, wherein the concavely rounded portion of the sole outer surface extends substantially through a portion of the sole outer surface formed by the bottom sole portion, as viewed in said heel portion frontal plane cross-section when the shoe sole is upright and in an unloaded condition.

29. The shoe according to claim 20, wherein the concavely rounded portion of the sole outer surface extends substantially continuously to a boundary of the lateral sidemost section of the shoe sole, as viewed in a frontal plane cross-section when the shoe sole is upright and in an unloaded condition.

30. The shoe according to claim 28, wherein the concavely rounded portion of the sole outer surface extends substantially continuously to a boundary of the medial sidemost section of the shoe sole, as viewed in a frontal plane cross-section when the shoe sole is upright and in an unloaded condition.

31. The shoe according to claim 20, wherein the concavely rounded portion of the sole outer surface extends substantially continuously to both a boundary of the lateral sidemost section of the shoe sole, and a boundary of the medial sidemost section of the shoe sole, as viewed in a frontal plane cross-section when the shoe sole is upright and in an unloaded condition.

32. The shoe according to claim 20, wherein the shoe is an athletic shoe.

33. The shoe according to claim 20, wherein the outer surface of the midsole component comprises a concavely rounded portion, the concavity being determined relative to an inner section of the midsole component located directly adjacent to the concavely rounded outer surface portion of the midsole component, as viewed in a frontal plane cross-section when the shoe sole is upright and in an unloaded condition.

34. The shoe sole according to claim 20, wherein the concavely rounded portion of the sole outer surface extends substantially to a lowest point of the sole outer surface, as viewed in a frontal plane cross-section when the shoe sole is upright and in an unloaded condition.

35. A shoe according to claim 20, wherein said sole outer surface concavely rounded portion is located at said sole medial side, and said sole lateral side also includes a concavely rounded portion extending at least from an uppermost point of a bottom sole portion substantially continuously through and above a sidemost extent of said sole outer surface, as viewed in said heel portion frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface.

36. A shoe having a shoe sole suitable for an athletic shoe, the shoe sole comprising:

a sole inner surface for supporting a foot of an intended wearer;

a sole outer surface;

a heel portion at a location substantially corresponding to the location of a heel of the intended wearer's foot when inside the shoe;

the shoe sole having a sole medial side, a sole lateral side and a sole middle portion located between said sole sides;

a midsole component having an inner surface and an outer surface;

a bottom sole which forms at least a part of the sole outer surface;

the inner surface of the midsole component of the sole middle portion comprising a convexly rounded portion, as viewed in a frontal plane cross-section when the shoe sole is upright and in an unloaded condition, the convexity of the convexly rounded portion of the inner surface of the midsole component existing with respect to a section of the midsole component directly adjacent to the convexly rounded portion of the inner surface of the midsole component;

the outer surface of the midsole component comprising a concavely rounded portion extending substantially through and beyond a lowest portion of the sole outer surface, as viewed in said frontal plane cross-section when the shoe sole is upright and in an unloaded condition, the concavity of the concavely rounded portion of the outer surface existing with respect to an inner section of the midsole component directly adjacent to the concavely rounded portion of the outer surface of the midsole component;

the sole having a lateral sidemost section located outside a straight vertical line extending through the shoe sole at a lateral sidemost extent of the inner surface of the midsole component, as viewed in said frontal plane cross-section when the shoe sole is upright and in an unloaded condition;

the sole having a medial sidemost section located outside a straight vertical line extending through the shoe sole at a medial sidemost extent of the inner surface of the midsole component, as viewed in said frontal plane cross-section when the shoe sole is upright and in an unloaded condition;

a portion of the midsole component and a portion of the bottom sole extend into one of said sidemost sections of the shoe sole side, as viewed in said frontal plane cross-section when the shoe sole is upright and in an unloaded condition;

said midsole portion located in a sidemost section of the shoe sole extending to a height above a lowest point of said inner surface of the midsole component, as viewed in said frontal plane cross-section when the shoe sole is upright and in an unloaded condition; and at least one cushioning compartment located between the sole inner surface and the sole outer surface, and said at least one cushioning compartment including one of a gas, gel or liquid.

37. The shoe according to claim 36, wherein a top portion of the at least one cushioning compartment is bounded by midsole, as viewed in said frontal plane cross-section when the shoe sole is upright and in an unloaded condition.

38. The shoe according to claim 36, wherein the sole outer surface concavely rounded portion extends at least substantially from said lowest portion of the sole outer surface substantially to a height above a lowest point of the inner surface of the midsole component, as viewed in said frontal plane cross-section when the shoe sole is upright and in an unloaded condition.

39. The shoe sole according to claim 36, wherein said convexly rounded portion of the inner surface of the midsole component and said concavely rounded portion of the sole outer surface are located in said heel portion.

40. The shoe according to claim 36, wherein said at least one cushioning compartment is defined by an outer surface having a concavely rounded portion, as viewed in said frontal plane cross-section when the shoe sole is upright and in an unloaded condition, the concavity of the concavely rounded portion of the outer surface of the at least one cushioning compartment existing with respect to inside the at least one cushioning compartment.

41. The shoe according to claim 36, wherein the at least one cushioning compartment is encapsulated.

42. The shoe according to claim 36, wherein a portion of a shoe upper of the shoe envelops on the outside a part of a midsole portion.

43. The shoe according to claim 36, wherein the sole outer surface concavely rounded portion extends at least from said lowest portion of the sole outer surface substantially to a sidemost extent of said sole side, as viewed in said frontal plane cross-section when the shoe sole is upright and in an unloaded condition.

44. The shoe according to claim 43, wherein the sole outer surface concavely rounded portion extends substantially from said sidemost extent of the sole outer surface of a sole side substantially to a sidemost extent of the sole outer surface of the other side, as viewed in said frontal plane cross-section when the shoe sole is upright and in an unloaded condition.

45. The shoe according to claim 44, wherein the sole outer surface concavely rounded portion extends substantially from the sidemost extent of the sole outer surface of a sole side substantially through a sidemost extent of the sole outer surface of the other sole side, as viewed in said frontal plane cross-section when the shoe sole is upright and in an unloaded condition.

46. The shoe according to claim 36, wherein the outer surface which defines the at least one cushioning compartment comprises an upper surface portion and a lower surface portion, the upper and lower surface portions of said at least one cushioning compartment contacting when the shoe is fully loaded under moderate body weight pressure and when the shoe is subjected to maximum normal peak landing forces during running.

47. The shoe according to claim 36, wherein the concavely rounded portion of the sole outer surface extends substantially continuously to a boundary of the lateral sidemost section of the shoe sole, as viewed in a frontal plane cross-section when the shoe sole is upright and in an unloaded condition.

48. The shoe according to claim 36, wherein the concavely rounded portion of the sole outer surface extends substantially continuously to a boundary of the medial sidemost section of the shoe sole, as viewed in a frontal plane cross-section when the shoe sole is upright and in an unloaded condition.

49. The shoe according to claim 36, wherein the concavely rounded portion of the sole outer surface extends substantially continuously to both a boundary of the lateral sidemost section of the shoe sole, and a boundary of the medial sidemost section of the shoe sole, as viewed in a frontal plane cross-section when the shoe sole is upright and in an unloaded condition.

50. The shoe according to claim 36, wherein the shoe is an athletic shoe.

51. The shoe according to claim 36, wherein the outer surface of the midsole component comprises a concavely rounded portion, the concavity being determined relative to an inner section of the midsole component located directly adjacent to the concavely rounded outer surface portion of the midsole component, as viewed in a frontal plane cross-section when the shoe sole is upright and in an unloaded condition.

52. The shoe according to claim 36, wherein the concavely rounded portion of the sole outer surface extends substantially through and beyond a midpoint of the shoe sole, as viewed in a frontal plane cross-section when the shoe sole is upright and in an unloaded condition.

53. The shoe sole according to claim 36, further comprising a bottom sole which forms at least part of the sole outer surface.

54. A shoe having a shoe sole suitable for an athletic shoe, the shoe sole comprising:

a sole inner surface for supporting a foot of an intended wearer;

a sole outer surface;

a heel portion at a location substantially corresponding to the location of a heel of the intended wearer's foot when inside the shoe;

the shoe sole having a sole medial side, a sole lateral side, and a sole middle portion located between said sole sides;

a midsole component having an inner surface and an outer surface;

a bottom sole which forms at least a part of the sole outer surface;

the inner surface of the midsole component of one of the sole medial and lateral sides comprising a convexly rounded portion, as viewed in a heel portion frontal plane cross-section when the shoe sole is upright and in an unloaded condition, the convexity of the convexly rounded portion of the inner surface of the midsole component existing with respect to a section of the midsole component directly adjacent to the convexly rounded portion of the inner surface of the midsole component, the sole outer surface of one of the sole medial and lateral sides comprising a concavely rounded portion, as viewed in said heel portion frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface, the convexly rounded portion of the inner surface of the midsole component and the sole outer surface concavely rounded portion both being located on the same sole side;

the sole having a lateral sidemost section located outside a straight vertical line extending through the shoe sole at a lateral sidemost extent of the inner surface of the midsole component, as viewed in said heel portion frontal plane cross-section when the shoe sole is upright and in an unloaded condition;

the sole having a medial sidemost section located outside a straight vertical line extending through the shoe sole at a medial sidemost extent of the inner surface of the midsole component, as viewed in said heel portion frontal plane cross-section when the shoe sole is upright and in an unloaded condition;

a portion of the midsole component and a portion of the bottom sole extend into one of said sidemost sections of the shoe sole side, as viewed in said heel portion frontal plane cross-section when the shoe sole is upright and in an unloaded condition;

said midsole portion located in a sidemost section of the shoe sole extending to a height above a lowest point of said inner surface of the midsole component, as viewed in said heel portion frontal plane cross-section when the shoe sole is upright and in an unloaded condition; and said midsole component is enveloped on the outside by a shoe upper portion extending below a height of the lowest point of the inner surface of the midsole component, as viewed in said heel portion frontal plane cross-section when the shoe is upright and in an unloaded condition.

55. The shoe according to claim 54, wherein the shoe sole further comprises a bottom sole which forms a portion of the sole outer surface; and the sole outer surface concavely rounded portion extends down to at least an uppermost point of a bottom sole portion, as viewed in said heel portion frontal plane cross-section when the shoe sole is upright and in an unloaded condition.

56. The shoe according to claim 54, wherein the sole outer surface concavely rounded portion extends substantially from a sidemost extent of the sole outer surface substantially to said uppermost point of said bottom sole portion, as viewed in said heel portion frontal plane cross-section when the shoe sole is upright and in an unloaded condition.

57. The shoe according to claim 54, wherein the concavely rounded portion of the sole outer surface extends substantially continuously to a boundary of the lateral sidemost section of the shoe sole, as viewed in a frontal plane cross-section when the shoe sole is upright and in an unloaded condition.

58. The shoe according to claim 54, wherein the concavely rounded portion of the sole outer surface extends substantially continuously to a boundary of the medial sidemost section of the shoe sole, as viewed in a frontal plane cross-section when the shoe sole is upright and in an unloaded condition.

59. The shoe according to claim 54, wherein the concavely rounded portion of the sole outer surface extends substantially continuously to both a boundary of the lateral sidemost section of the shoe sole, and a boundary of the medial sidemost section of the shoe sole, as viewed in a frontal plane cross-section when the shoe sole is upright and in an unloaded condition.

60. The shoe according to claim 54, wherein the shoe is an athletic shoe.

61. The shoe according to claim 54, wherein the outer surface of the midsole component comprises a concavely rounded portion, the concavity being determined relative to an inner section of the midsole component located directly adjacent to the concavely rounded outer surface portion of the midsole component, as viewed in a frontal plane cross-section when the shoe sole is upright and in an unloaded condition.

62. The shoe sole according to claim 54, wherein the concavely rounded portion of the sole outer surface extends substantially to a lowest point of the sole outer surface, as viewed in a frontal plane cross-section when the shoe sole is upright and in an unloaded condition.

63. A shoe according to claim 54, wherein said sole outer surface concavely rounded portion is located at said sole medial side, and said sole lateral side also includes a concavely rounded portion, as viewed in said heel portion frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface.

64. A shoe having a shoe sole suitable for an athletic shoe, the shoe sole comprising:

a sole inner surface for supporting a foot of an intended wearer;

a sole outer surface;

a heel portion at a location substantially corresponding to the location of a heel of the intended wearer's foot when inside the shoe;

the shoe sole having a sole medial side, a sole lateral side and a sole middle portion located between said sole sides;

a midsole component having an inner surface and an outer surface;

a bottom sole which forms at least part of the sole outer surface;

the inner surface of the midsole component of one of the sole medial and lateral sides comprising a convexly rounded portion, as viewed in a heel portion frontal plane cross-section when the shoe sole is upright and in an unloaded condition, the convexity of the convexly rounded portion of the inner surface of the midsole component existing with respect to a section of the midsole directly adjacent to the convexly rounded portion of the inner surface of the midsole component, the sole outer surface of one of the sole medial and lateral sides comprising a concavely rounded portion formed by a bottom sole portion and located below a height of a lowest point of the inner surface of the midsole component, as viewed in said heel portion frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface, the convexly rounded portion of the inner surface of the midsole component and the concavely rounded portion of the sole outer surface formed by a bottom sole portion both being located on the same sole side;

the sole having a lateral sidemost section located outside a straight vertical line extending through the shoe sole at a lateral sidemost extent of the inner surface of the midsole component, as viewed in said heel portion frontal plane cross-section when the shoe sole is upright and in an unloaded condition;

the sole having a medial sidemost section located outside a straight vertical line extending through the shoe sole at a medial sidemost extent of the inner surface of the midsole component, as viewed in said heel portion frontal plane cross-section when the shoe sole is upright and in an unloaded condition;

a portion of the midsole component and the bottom sole portion extend into hath of said sidemost sections of the shoe sole, as viewed in said heel portion frontal plane cross-section when the shoe sole is upright and in an unloaded condition;

said midsole portion located in a sidemost section of the shoe sole extending to a height above the lowest point of said inner surface of the midsole component, as viewed in said heel portion frontal plane cross-section when the shoe sole is upright and in an unloaded condition; and at least one cushioning compartment located between the sole inner surface and the sole outer surface of the heel portion, the at least one cushioning compartment including one of a gas, gel, or liquid, and being defined by an outer surface comprising a concavely rounded portion, as viewed in said heel portion frontal plane cross-section when the shoe sole is upright and in an unloaded condition, the concavity of the concavely rounded portion of the outer surface which defines the at least one cushioning compartment existing with respect to inside each respective cushioning compartment.

65. The shoe according to claim 64, wherein the concavely rounded portion of the sole outer surface formed by a bottomsole portion extends into a sidemost section of at least one sole side, as viewed in said heel portion frontal plane cross-section when the shoe sole is upright and in an unloaded condition.

66. The shoe according to claim 64, wherein the sole outer surface concavely rounded portion extends substantially from the sidemost extent of said sole side substantially to a sidemost extent of the other sole side, as viewed in said heel portion frontal plane cross-section when the shoe sole is upright and in an unloaded condition.

67. The shoe sole according to claim 64, wherein the convexly rounded portion of the inner surface of the midsole component extends substantially to a lowest point of the inner surface of the midsole component, as viewed in a frontal plane cross-section when the shoe sole is upright and in an unloaded condition.

68. The shoe according to claim 64, wherein the cushioning compartment is encapsulated.

69. The shoe according to claim 64, wherein the shoe is an athletic shoe.

70. The shoe according to claim 64, wherein a portion of a shoe upper of the shoe envelops on the outside a part of the midsole portion.

71. The shoe sole according to claim 64, further comprising a sole outer surface concavely rounded portion formed by midsole extending up from the bottom sole portion, as viewed in said heel portion frontal plane cross-section when the shoe sole is upright and in an unloaded condition.

72. The shoe according to claim 64, wherein the concavely rounded portion of the sole outer surface extends substantially continuously to a boundary of the lateral sidemost section of the shoe sole, as viewed in a frontal plane cross-section when the shoe sole is upright and in an unloaded condition.

73. The shoe according to claim 64, wherein the concavely rounded portion of the sole outer surface extends substantially continuously to a boundary of the medial sidemost section of the shoe sole, as viewed in a frontal plane cross-section when the shoe sole is upright and in an unloaded condition.

74. The shoe according to claim 64, wherein the concavely rounded portion of the sole outer surface extends substantially continuously to both a boundary of the lateral sidemost section of the shoe sole, and a boundary of the medial sidemost section of the shoe sole, as viewed in a frontal plane cross-section when the shoe sole is upright and in an unloaded condition.

75. The shoe sole according to claim 64, wherein the concavely rounded portion of the sole outer surface extends substantially to a lowest point of the sole outer surface, as viewed in a frontal plane cross-section when the shoe sole is upright and in an unloaded condition.

76. The shoe according to claim 64, wherein the outer surface of the midsole component comprises a concavely rounded portion, the concavity being determined relative to an inner section of the midsole component located directly adjacent to the concavely rounded outer surface portion of the midsole component, as viewed in a frontal plane cross-section when the shoe sole is upright and in an unloaded condition.

77. A shoe according to claim 64, wherein said sole outer surface concavely rounded portion is located at said sole medial side, and said sole lateral side also includes a concavely rounded portion formed by a bottom sole portion and extending below a lowest point of the inner surface of the midsole component, as viewed in said heel portion frontal plane cross-section when the shoe sole is upright and in an unloaded condition, the concavity of the concavely rounded portion of the sole outer surface existing with respect to an inner section of the shoe sole directly adjacent to the concavely rounded portion of the sole outer surface.

* * * * *

UNITED STATES PATENT AND TRADEMARK OFFICE

CERTIFICATE OF CORRECTION

PATENT NO. : 6,487,795 B1
DATED : December 3, 2002
INVENTOR(S) : Frampton E. Ellis, III It is certified that error appears in the above-identified patent and that said Letters Patent is hereby corrected as shown below:

Column 14,
Line 49, replace “claim 28” with -- claim 20 --; and

Column 20,
Line 20, replace “hath” with -- both --.

Signed and Sealed this

Twenty-ninth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,487,795 B1
DATED : December 3, 2002
INVENTOR(S) : Frampton E. Ellis, III It is certified that error appears in the above-identified patent and that said Letters Patent is hereby corrected as shown below:

Title page,
Item [63], should read -- [63] Continuation of U.S. patent application No. 07/926,523, filed on Aug. 10, 1992, now abandoned, which is a continuation-in-part of U.S. patent application No. 07/463,302, filed on Jan. 10, 1990, now abandoned. --

Drawings,
Please replace Sheet 5, Fig. 9A with the following:

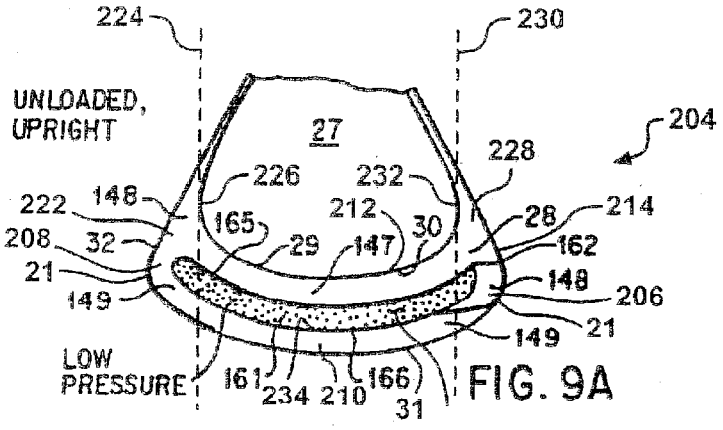

FIG. 9A

Column 1,
Lines 3-7, should read -- This application is a continuation of U.S. patent application No. 07/926,523, filed on Aug. 10, 1992, now abandoned, which is a continuation-in-part of U.S. patent application No. 07/463,302, filed on Jan. 10, 1990, now abandoned. --

Signed and Sealed this

Second Day of September, 2003

JAMES E. ROGAN
*Director of the United States Patent and Trademark Office*